United States Patent [19]

Wheelwright et al.

[11] 4,137,810

[45] Feb. 6, 1979

[54] DIGITALLY ENCODED TOP OCTAVE FREQUENCY GENERATOR

[75] Inventors: Robert W. Wheelwright, Amherst; Peter E. Solender, Williamsville, both of N.Y.

[73] Assignee: The Wurlitzer Company, Chicago, Ill.

[21] Appl. No.: 758,598

[22] Filed: Jan. 12, 1977

[51] Int. Cl.[2] ..... G10H 1/00

[52] U.S. Cl. ..... 84/1.03; 84/1.22

[58] Field of Search ..... 84/1.01, 1.03, 1.2, 84/1.22, 1.23

[56] References Cited

U.S. PATENT DOCUMENTS 3,939,751 2/1976 Harasek ..... 84/1.01

*Primary Examiner*—Robert K. Schaefer
*Assistant Examiner*—Leonard W. Pojunas, Jr.
*Attorney, Agent, or Firm*—Olson, Trexler, Wolters, Bushnell & Fosse, Ltd.

[57] ABSTRACT

A LSI (large scale integrated circuit) device is disclosed which generates 12 output frequencies related to each other by a multiple of the twelfth root of two from a common time base without the use of parallel divider or shift register strings. The output frequencies comprise the top octave, or a multiple thereof, of the frequencies of an electronic musical instrument. A binary counter serves as a common time base and encodes each wave form period in a form of a binary code. A binary processing circuit associated with each output frequency stores the count position of the next desired wave form transition and updates the stored code after each transition has occurred. The binary processing circuitry comprises a latch circuit, a binary full adder or ROM (read only memory), a digital comparator or ROM, and a J-K flip-flop circuit. The outputs can be easily modified in both actual frequency and waveform symmetry.

27 Claims, 9 Drawing Figures

1 2 4 8 16 32 64 128 256
LATCH
34
$Q_1$
22
60
76
72
78
74
58
36
B+
ADDER
ADDER
B+
70
$B_1$
$C_I$
68
CLOCK
58
44
56
54
COMPARATOR
COMPARATOR
66
48
55
50
64
J Q
CLOCK
C
K $\bar{Q}$
B+
64
52
B+

DIGITALLY ENCODED TOP OCTAVE FREQUENCY GENERATOR

BACKGROUND OF THE INVENTION

Generation of electrical signals corresponding to musical tones in electronic organs and other musical instruments has been effected in the past by many different structures. Electro-mechanical devices have been used, such as windblown, vibrating reeds, rotating tone wheels with magnetic or photoelectric transducers, or actual recordings of conventional musical instruments. Probably the most prevalent practice in recent years has been the provision of 12 discrete oscillators to generate the semitones of the top octave of the instrument (or harmonics thereof), each driving a divide-by-two divider train to produce the corresponding frequencies of lower octaves of the instrument. This has required individual tuning of the 12 discrete master oscillators, but of course has avoided tuning of the corresponding notes of lower octaves.

With the advent of large scale integrated circuits it has been possible to provide a single radio frequency oscillator with a plurality of parallel divider paths of different divider ratio to produce the 12 frequencies of the top octave of the instrument, followed by the known divide-by-two circuits to produce the corresponding frequencies of lower octaves. This has reduced the tuning requirements during manufacture to a single oscillator. Such a generating system is suggested in Freeman U.S. Pat. No. 3,236,931, and is clearly taught in Reyers U.S. Pat. No. 3,590,131. This structure has proved commercially acceptable. However, these circuits have division ratios and waveform symmetry properties that are difficult and/or costly to modify.

OBJECTS AND SUMMARY OF THE PRESENT INVENTION

The object of the present invention is to provide an all digital waveform generating system for an electronic musical instrument which is capable of being completely reduced to large scale integrated circuits.

A further object of the present invention is to provide a waveform generating system for an electronic musical instrument which produces 12 output frequencies corresponding to the top octave of tones of the instrument from a common time base without the use of parallel fixed divider or shift register strings.

Specifically, an object of the present invention is to provide such a frequency generator system utilizing a binary counter as a common time base and encoding each wave form period in the form of a binary code in combination with a data processing system.

In attaining these objects, a binary encoded top octave frequency generator is provided comprising an LSI (large scale integrated circuit) which generates 12 output frequencies related to each other by a multiple of the twelfth root of two from a common time base, provided by the binary counter. Each wave form period is encoded in the form of a binary code. A binary processing circuit associated with each output frequency stores the count position of the next desired wave form transition period and updates the stored code after each transition has occurred. Thus by altering transition points, varying symmetry of output per cycle or even frequency can be easily accomplished by simple transition point changes.

THE DRAWING AND DESCRIPTION OF THE ILLUSTRATED EMBODIMENT

The present invention will best be understood with reference to the drawings and the accompanying specification. In the drawings:

FIG. 1 comprises a perspective view of an organ or other electronic musical instrument constructed in accordance with the present invention;

FIG. 2 comprises a block diagram of the invention;

Figure 1:
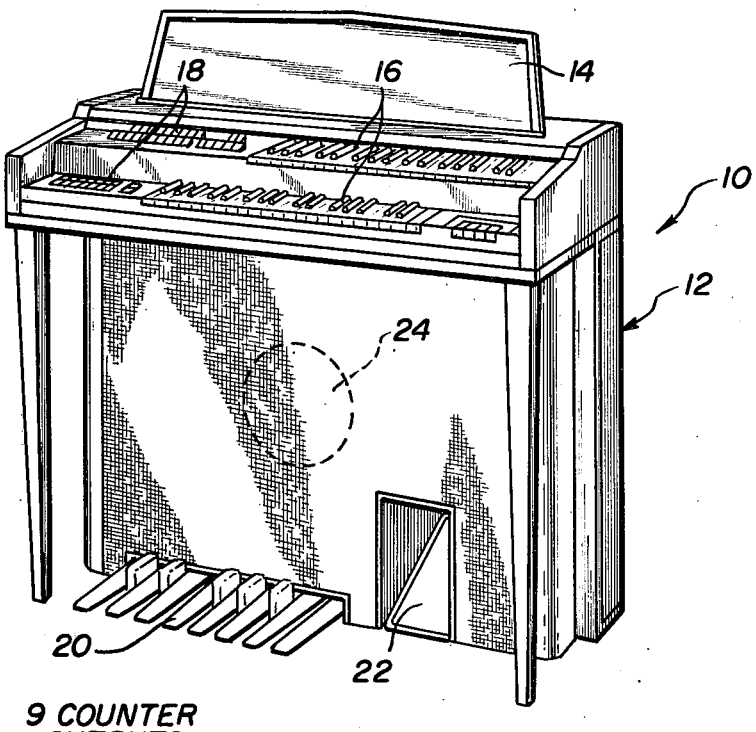

Attention first should be directed to FIG. 1 wherein there is shown an electronic organ 10 in which the present invention is incorporated. The organ is of the spinet type having a case 12 with a music rack 14 at the top thereof, and with overlapping keyboards 16 immediately below and in front of the music rack. Stop tablets and control switches 18 are incorporated adjacent the keyboards. The organ also is provided with a pedal keyboard or clavier 20 and with a swell pedal 22. A loudspeaker system 24 comprising one or more loudspeakers is housed in the front of the cabinet behind a suitable grill cloth.

Figure 2:
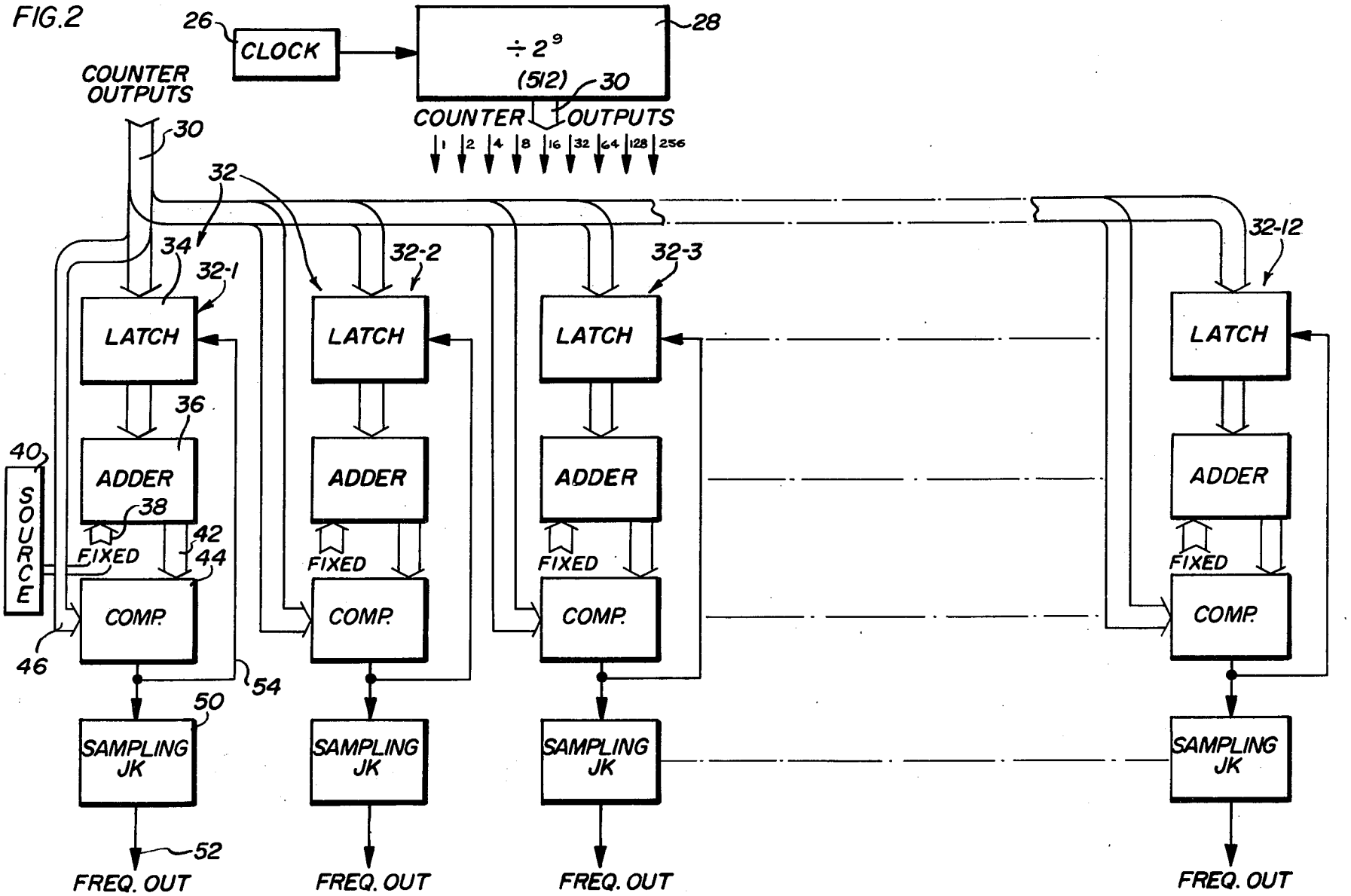

Turning now to FIG. 2, there is shown a tone generating system in accordance with the present invention, and which would be incorporated in the organ illustrated in FIG. 1. A high frequency digital (f.i. 4 MHZ) clock 26 provides signals to a digital counter 28 capable of counting to 512. In basic form the counter could be a set of 9 J-K flip-flops with no resets or presets, thus to provide 9 stages of divide-by-two. It could be a ripple through counter, or a synchronous counter. The counter is provided with outputs shown lumped together at 30, but actually comprising separate outputs; as shown, there are 9 outputs for the binary counter example labeled 1,2,4,8,16,32,64, 128 and 256. In all, there are 512 different state combinations of the outputs through which the counter continuously cycles. The left most output, namely bit 1 is conventionally referred to as the least significant bit (LSB), while the right most or 9th output indicated as 256 is the most significant bit (MSB).

The counter outputs 30 are connected to each of 12 parallel frequency branches 32 for binary processing. The 12 branches are identical except as herinafter noted, and for convenience are respectively labeled 32-1, 32-2, through 32-12.

Each frequency branch comprises at the entering or input end a latch circuit 34. The output of the latch circuit is connected to an adder 36 which is a binary full adder circuit, or else a ROM (read only memory). A second input to the adder is provided at 38 and comprises a fixed binary word obtained from a number source 40. All of the frequency branches are the same except for the fixed binary word which is different for each branch.

The output from the adder 36 is applied at 42 to a digital comparator (or a ROM) 44. The counter output 30 also is applied to the comparator at 46. The output of the comparator is applied at 48 to a sampling J-K flip-flop 50. The output of the J-K flip-flop 50 comprises the output of the frequency branch which is a frequency out at 52. The comparator output is fed on line 54 to the latch 34.

As indicated heretofore the time base counter outputs at 30 are fed to the latch 34 and comparator 44 in each of the 12 individual branches. The code stored in the latch represents the last wave form transition time relative to the time base code for that particular frequency. This code, when added to the fixed code at the other input 38 of the full adder, produces a composite code which is then used to specify the count position of the next wave form transition. The carry bit from the full adder is not utilized since the time base code is fixed in a maximum capacity of 512. Thus the code at the output of the full adder is always between 0 and 511. To illustrate this process assume that the last transition occured at count 400 and the desired interval (fixed code) is 300. The next transition interval would then be (400 + 300) − 512 = 188. The actual binary arithmetic would be of the following form:

| | |
|---|---|
| 400 | 110010000 |
| 300 | 100101100 |
| 188 | 010111100 |

In the above example the time interval produced with a 4 MHz clock rate is 300 × 0.25 usec = 75 usec. Since the actual period of the sampling J-K flip-flop is twice the interval the resultant frequency is 6.667 KHz. Similarly, a fixed count of 301 would produce a frequency of 6.644 KHz.

Using this technique the desired frequency outputs for a twelfth root of two top octave synthesis and the corresponding interval count information for a 4 megahertz clock rate is specified in Table 1.

Table #1

| Frequency List | | | |
|---|---|---|---|
| Nominal Frequency (HZ) | Count Interval | Actual Frequency (HZ) | Deviation* (Cents) |
| 4186.010 | 478 | 4184.1 | −.79 |
| 4434.922 | 451 | 4434.59 | −.13 |
| 4698.636 | 426 | 4694.84 | −1.4 |
| 4978.032 | 402 | 4975.124 | −1.01 |
| 5274.042 | 379 | 5277.045 | +.99 |
| 5587.652 | 358 | 5586.592 | −.33 |
| 5919.910 | 338 | 5917.160 | −.80 |
| 6271.928 | 319 | 6269.592 | −.64 |
| 6644.876 | 301 | 6644.518 | −.10 |
| 7040.0 | 284 | 7042.254 | +.55 |
| 7458.620 | 268 | 7462.687 | +.94 |
| 7902.132 | 253 | 7905.138 | +.66 |

$$*\Delta \text{ Cents} = 1200\left[\frac{\ln (f_1/f_2)}{\ln 2}\right]$$

In the foregoing table the third frequency is indicated as having a deviation of −1.4 cents. This can be improved with a slightly modified technique which will be described later in the narrative.

Figure 3:
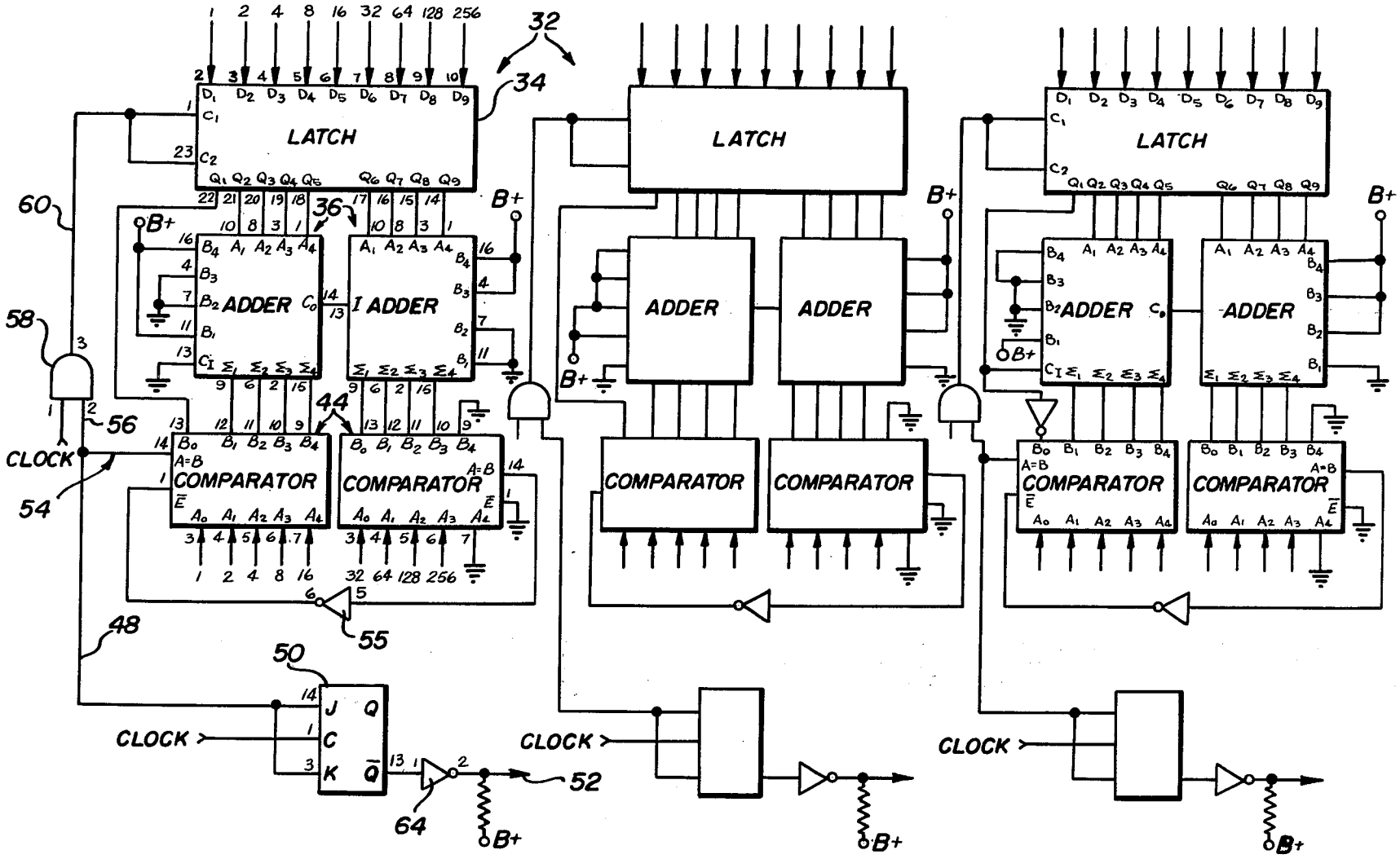
FIG. 3 is a block diagram generally similar to FIG. 2 but expanded therefrom.

A practicalization of the block diagram of FIG. 2 with commercially available components is shown in FIG. 3. Three parallel frequency channels are shown, and identifications are applied in some detail to the components of the left most channel. The latch 34 comprises a type 8202-10 bit latch, manufactured by Signetics, Inc., and the counter outputs are applied thereto at pins 2 through 10, inputs $D_1$ through $D_9$ respectively. The outputs of Q1 through Q9 are taken from the pin numbers as shown in FIG. 3, all of which, except for that corresponding to the least significant bit, are applied to the adder 36.

The adder 36 comprises two commercially available adders, each being a type number 7483-4 bit Binary Adder manufactured by Texas Instruments, Inc. The two 4 bit adders together provide the capability of adding two 8 bit binary numbers. The least significant bit is taken from Q1 and is connected directly to the comparator 44, bypassing the adder. It will be realized that this is done because of the availability of 4 bit adders in present day commercially available integrated circuit chips. Thus in custom LSI chips a 9-bit adder could be used eliminating the need for separating the least significant bit processing. In that instance, the adder could be a single Read Only Memory or gating matrix which could process two — 9 bit numbers, or more generally any two numbers regardless of bit length.

The two 4 bit adders are connected as indicated with a connection from carry out, pin 14 of the left adder chip to the carry in, pin 13, of the right adder chip. It will be understood that the pins as shown in FIG. 3 are as shown in a particular implementation of the concept using commerically available integrated circuits.

The inputs labeled $B_1$, $B_2$, $B_3$ and $B_4$ on the two binary adders and the carry in input labeled $C_I$ provide the interval adjustment per each frequency branch. Assuming that the left most frequency branch or chain corresponds to the #4 frequency in the list of produced frequencies (4975.124) (table 1), the counter interval is 402. The binary equivalent for 402 is 110010010. This number must be added to the count stored in latch 34 to obtain the next code where a transition must occur. Since the least significant bit of the binary number 402 is a logic 0, the sum of the least significant bit in latch 34 with the fixed interval is always just the least significant bit in latch 34. There can be no carry into the left adder $C_I$ (Pin 13). The rest of the binary number 402 (count interval) is fed into the inputs of the adders in the left most chain in sequence. Table #2 shows the relationship for the left most chain for the adder inputs and comparator inputs.

Table #2

| | Count Interval | Adder Input | Comparator Input |
|---|---|---|---|
| (Least Significant Bit) | 0 | None | Latch 34 Pin 22 (Q1) |
| | 1 | Left B1 | Left E1 |
| | 0 | Left B2 | Left E2 |
| | 0 | Left B3 | Left E3 |
| | 1 | Left B4 | Left E4 |
| | 0 | Right B1 | Right E1 |
| | 0 | Right B2 | Right E2 |
| | 1 | Right B3 | Right E3 |
| (Most significant Bit) | 1 | Right B4 | Right E4 |

COUNT INTERVAL RELATIONSHIPS

It should be noted that if the Count Interval least significant bit output is a binary 1, the comparator least significant bit input will be a binary 0 if the latch LSB output is a binary 1 (with a corresponding carry input $C_I$ into the left most adder). In a similar way the comparator least significant bit input will be a binary 1 if the latch LSB output is a binary 0 (with no carry into input $C_I$ in the left most adder). This is shown in the right most frequency chain in FIG. 3. In all cases on FIG. 3, a B+ indicates a logic "1" and a ground symbol indicates a logic "0." It is solely the different connections for the count interval on the adders which sets up different frequencies.

Different combinations of logic levels on the adder inputs will be seen in the second and third branches shown in FIG. 3. Pin numbers are left off of these branches to avoid crowding the drawing, but will be understood as being the same by position as in the left branch. It should perhaps be mentioned at this time that the connection between pin 14 of the left adder and pin 13 of the right adder comprises the carry line.

The output or summation of the adder is applied direct to the comparator as shown in FIG. 3 and table 2. The comparator comprises two commercially available chips, each a Fairchild Semiconductor Type 9324. These integrated circuits are 5 bit binary comparators. The connections from the adder to the comparator are the "B" inputs of the comparator, as shown. The connection to the "A" inputs comprises the counter outputs as indicated. These counter outputs are the same as the inputs to the latch circuit 34. On the right comparator chip pin number 1 ($\overline{E}$) an enable input is connected to ground. The right comparator output A=B on pin 14 is connected through an inverter 55 back to the enable input ($\overline{E}$) pin 1 of the left comparator chip. Pin 14 (A=B) of the left comparator chip is connected to a junction 56. This output (pin 14) will be high (a logic "1") if the "B" inputs to the comparator are identical to the "A" inputs.

Junction 56 is connected to one of the two inputs of an AND gate 58. The master clock is connected to the other input of the AND gate, and the output thereof is connected to a line 60 leading to pins 1 and 23 of the latch 34. This comprises the feedback circuit 54 of FIG. 2. Everytime the counter counts a number of clock pulses equivalent to the count interval (as indicated by the comparator output 54) line 60 will store the new counter state into the latch.

Terminal 56 also is connected through a line 48 to the sampling J-K flip-flop 50. The line is connected to both the J and K inputs, pins 14 and 3. The clock is connected to the C input on pin 1. The $\overline{Q}$ output of the J-K flip-flop 50 is connected to inverter 64, and the output thereof on line 52 comprises the frequency output referred to in FIG. 2. Whenever the comparator output 54 indicates a comparison (counter has counted equivalent to count interval), the J-K flip-flop 50 will toggle. The period of the flip-flop 50 output is equivalent to the time taken for two successive comparisons.

Figure 4:
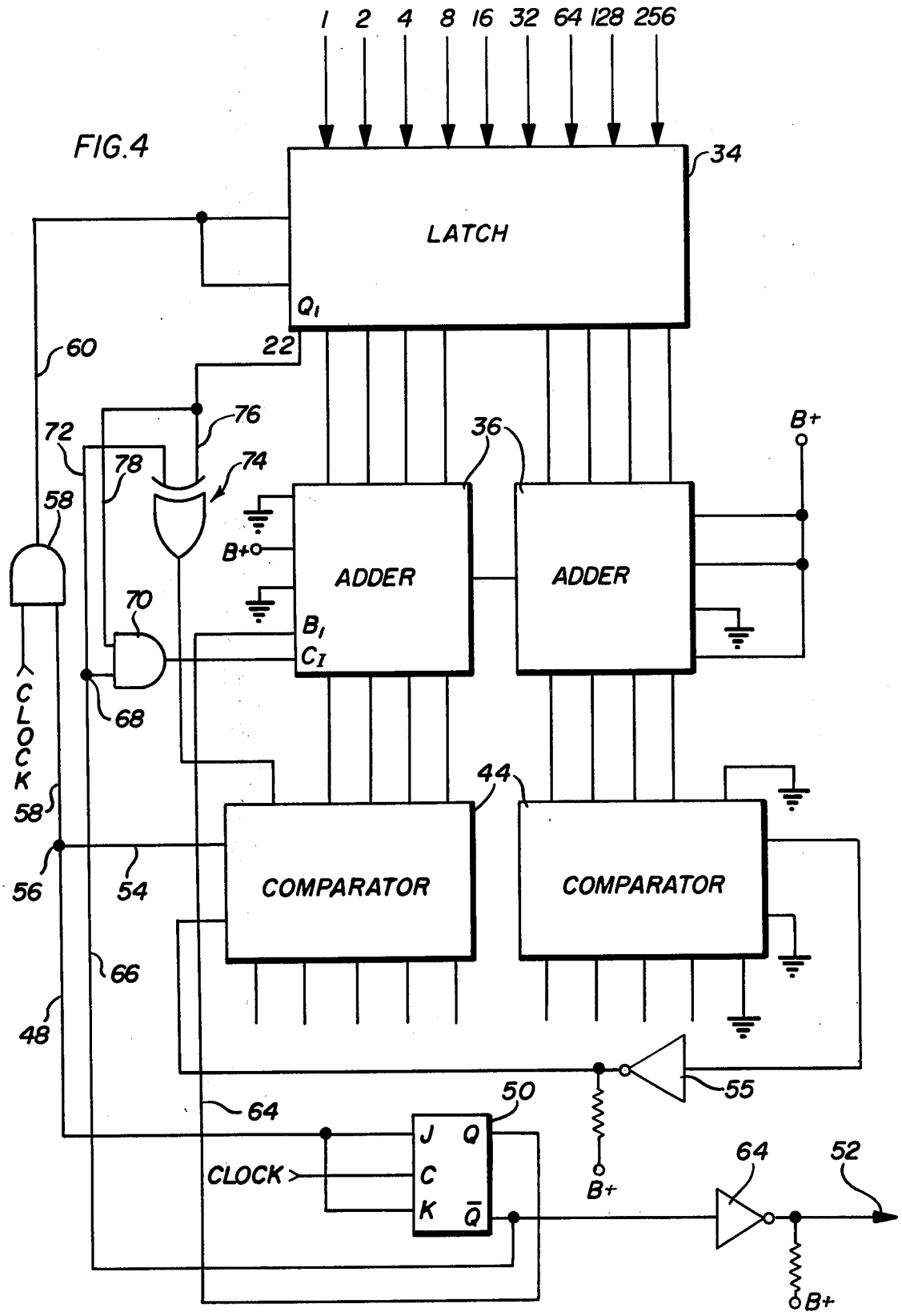
FIG. 4 is similar to a portion of FIG. 3 but illustrates a modification thereof for a particular frequency.

In table 1 as mentioned previously, the third frequency deviation can be improved. A count interval of 425.5 can be produced which will decrease the deviation to 0.63 cents at a frequency of 4700.35 Hz. The structure to achieve the fractional counter interval is shown in FIG. 4. The basic make up of the circuit is generally identical with that of FIG. 3. The numbers used are the same, and repetition of like parts is quite unnecessary. Distinctions are that the Q output of the J-K flip-flop 50 is fed back on a line 64 to the B1 input to the left adder chip 36. In addition the $\overline{Q}$ output is fed back along a line 66 to a junction 68 leading to one input of an AND gate 70, the output of which is connected to the $C_I$ (carry) input of a left adder unit 36. The junction 68 also is connected by a line 72 to the input of an exclusive OR gate 74. The Q1 output from pin 22 of the latch 34, rather than going direct to the comparator, comprises the other input of the exclusive OR gate 74 along a line 76. The Q1 output of the latch 34 also is connected on a line 78 to the other input of the AND gate 70. The exclusive OR gate 74 and the AND gate 70 together provide a 1 bit binary full adder for the least significant bit. The exclusive OR gate 74 provides the summed output and the AND gate 70 the carry output. The result of these connections is alternating count intervals of 425 and 426, producing an average of 425.5. The remainder of the circuit operates in similar fashion to FIG. 3 and the result produced is a very slightly asymmetrical wave which is only 1/10 of 1 percent off from an exact square wave.

Figure 5:
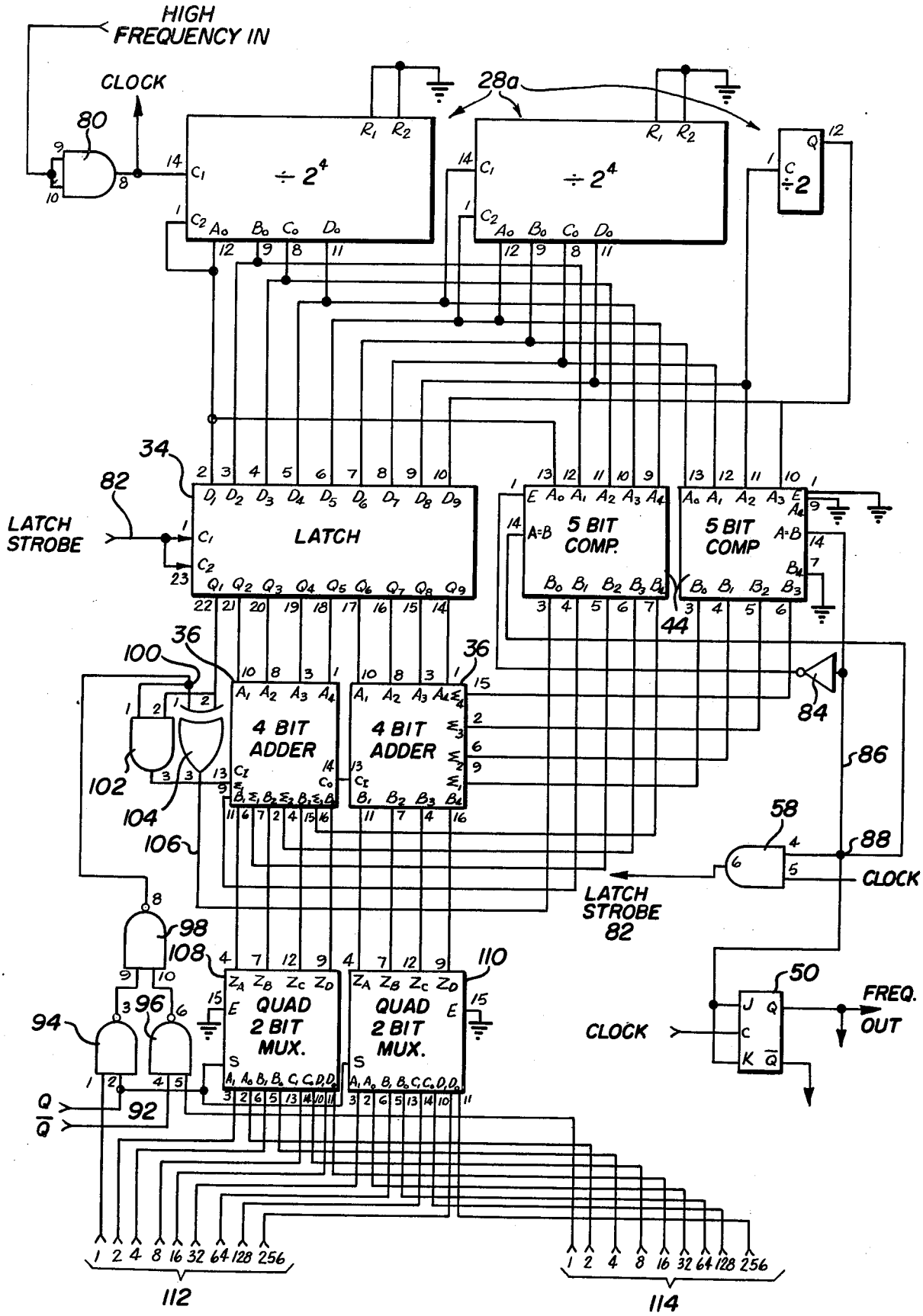
FIG. 5 is a block diagram illustrating a variable symmetry system.

In accordance with the disclosure as heretofore set forth a substantially exact square wave is generated. This is quite adequate for most purposes. If an exact square wave is needed a single ÷ 2 could be inserted after the circuit. However, for some purposes it is desirable to produce a rectangular or pulse wave which is not a true square wave. For example it is known that some piano tones have harmonic contents similar to that produced by a rectangular wave with approximately a one-eight duty cycle. A modification of the basic circuit is shown in FIG. 5, this circuit is capable of producing a non-symmetrical duty cycle rectangular waveform. The high frequency input is connected through an AND gate 80 (Buffer) to provide the clock, as indicated, and also to pin 14 of a counter 28*a*. In this instance the counter comprises a ÷ 512 counter. This is produced by two 4 bit binary counters and a single J-K flip-flop. Each such binary counter portion comprises a type 7493 chip manufactured by Texas Instruments, with connections as shown. The J-K flip-flop is a type 7473 chip also manufactured by Texas Instruments. A Do output of the left of the two binary counter chips is connected to the C1 contact, pin 14, of the right most of the two binary counter chips. In addition the $D_o$ contact of the right binary counter is connected to the C contact J-K flip-flop. The latch 34 is as before, but the input to pins 1 and 23 is indicated as a latch strobe 82 and comes from AND gate 58.

The output of the latch is connected to two 4-bit adders 36, as before. In this instance the "fixed" number inputs to the adders are indicated along the bottom, rather than on the sides of the adders, with pin numbers as before. As will be seen these are in this case not fixed numbers, i.e., plus 5 volts or ground. This will appear in greater detail hereinafter.

The summation outputs of the adders are connected to two comparator chips 44 as before, the input being to the B connections, with the A connections receiving input from the counter as before. The A = B output pin 14 on the right comparator block 44 is connected as before through inverter 84 to the enable input of the left comparator. The A = B output, pin 14, of the left comparator chip is connected through a line 86 to a junction 88 which leads to AND gate 58, the second input of which comprises the clock, as previously discussed. Junction 88 also leads to inputs J and K of a J-K flip-flop 50 providing the output frequency from the Q output, and also providing an inverse output from the Q connection. The output of the AND gate 58 is the latch strobe 82 which strobes the latch 34, as previously mentioned.

Lines 112 and 114 in FIG. 5 are the count intervals for adjacent parts of a rectangular wave. These two groups of lines are each designated 1,2,4,8,16,32,64,128,256. In order to address these two line groups, the Q output of the J-K flip-flop 50, besides providing frequency out, leads to a junction 92 leading to an NAND gate 94. In addition, like NAND gate 96 is shown adjacent the NAND gate 94, one input thereto being the Q output from J-K flip-flop 50. The other inputs to NAND gates 94 and 96 are the first or least significant bit (LSB) of the count intervals produced respectively by the "1" lines of groups 112 and 114. The outputs of the two NAND gates 94 and 96 comprise the inputs to a third NAND gate 98, the output of which leads to a junction 100. The connection from the junction is to a full adder for the LSB with AND gate 102 providing the carry function to $C_I$ of the left adder chip 36 and exclusive OR gate 104, providing the summed output for the LSB. The other input of both AND gate 102 and exclusive OR 104 is from the Q1 output, pin 22, of the latch 34 (The LSB output of the storage latch 34). The output of the exclusive OR gate 104 which is the LSB summed signal leads by way of a line 106 to input $B_o$ of the left chip of the comparator 44. The other corresponding lines of groups 112 and 114 lead to circuits similar in construction to gates 94, 96, and 98. These are contained within 2 bit multiplexers 108 and 110. These multiplexers are type 9322 manufactured by Fairchild Semiconductor. The inputs to the multiplexers from the groups 112 and 114 are fixed intervals set up with the lines tied to either + 5V or ground. The two phases Q and $\overline{Q}$ of the flip-flop 50 control the choosing of the respective interval groups 112 and 114 through the multiplexers, and hence cause the overall interval number to alternate into adder 36. In this manner, any sort of asymmetry can be obtained, for a rectangular waveform, and hence the harmonic content of the waveform can be varied. The remainder of the operation of FIG. 5 is identical to that described for FIG. 3.

In accordance with the invention as heretofore shown and described there is generally a fixed number or pair of fixed numbers, applied to the adders. As is shown fragmentarily in FIG. 6 the adder 36 (representative of any frequency channel) could receive the interval number combination of ones and zeros from a ROM 116 having a control 118 therefor. The output of the ROM also may extend to other adders in other frequency branches. By this manner the "fixed" (interval) number inserted in each adder may be changed according to a predetermined program, whereby to effect automatic transposition with no effort on the part of the player other than to operate normal controls. Transposition can also be between scales. The control 118 could be counter driven or sequenced by a separate rate or by the frequency output. In this way, the waveform can be varied as a function of time.

Figure 6:
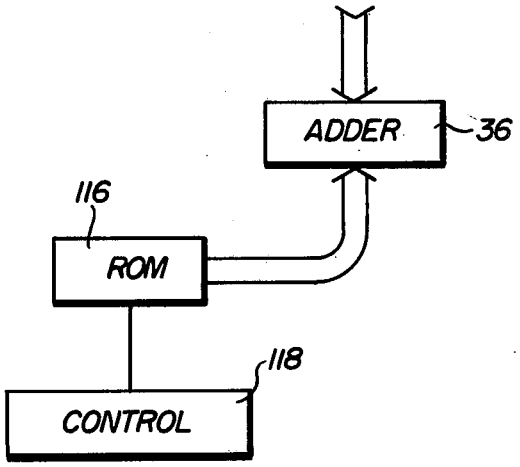
FIG. 6 illustrates a modification of the invention.

A modification of the invention appearing in block form identical with that of FIG. 6 will use a ROM to control the duty cycle as a function of time providing greater flexibility than the circuit of FIG. 5. Indeed, a ROM of proper design can simultaneously be used to control the duty cycle and also afford transposition. As is now obvious any number of transitions up to the actual number of counter states is possible so that multiple pulses per cycle of output is possible.

Figure 7:
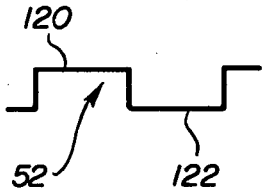
FIG. 7 illustrates the manner in which a square wave is constructed in accordance with the present invention.

With the circuits as heretofore shown and described, the operation is such that the "fixed" number source into the adder produces an output from the adder and hence from the comparator every so many counts, depending on the fixed number fed into the adder. For example, the seventh count interval down in table #1 (output frequency = 5919.910Hz) will hold the output from the sampling J-K 50, i.e., the frequency output 52, high as indicated at 120 in FIG. 7. After 338 counts the flip-flop will toggle, and the output will be low as indicated at 122 for the next 338 counts, then toggle back to high again. Accordingly, a square wave is generated having, in this particular illustrative embodiment, a transition every 338 counts. At a clock frequency of 4 MHz, the actual frequency thus produced will be 5917.160, as contrasted with a nominal frequency of 5919.910. This is a deviation of only −0.80 cents, from the exact 12th root frequency a difference which cannot be heard by the normal ear.

As also will be apparent from the foregoing, the system depends upon coincidence, as indicated by a logic comparator and hence is a DC, not an AC system relying on transition.

In order to keep the internal logic operating speeds to a minimum and to eliminate the parallel adders, it is possible to add the latch outputs and fixed codes serially at a rate much less than the main clock speed. Since the highest output frequency required is less than 10 KHz, the minimum count interval is always greater than 50 usec. Thus, the 9 code bits could be added in a serial number utilizing a 250 KHz processing rate in 36 usec and allowing a minimum transition set up time of 14 usec.

Figure 8:
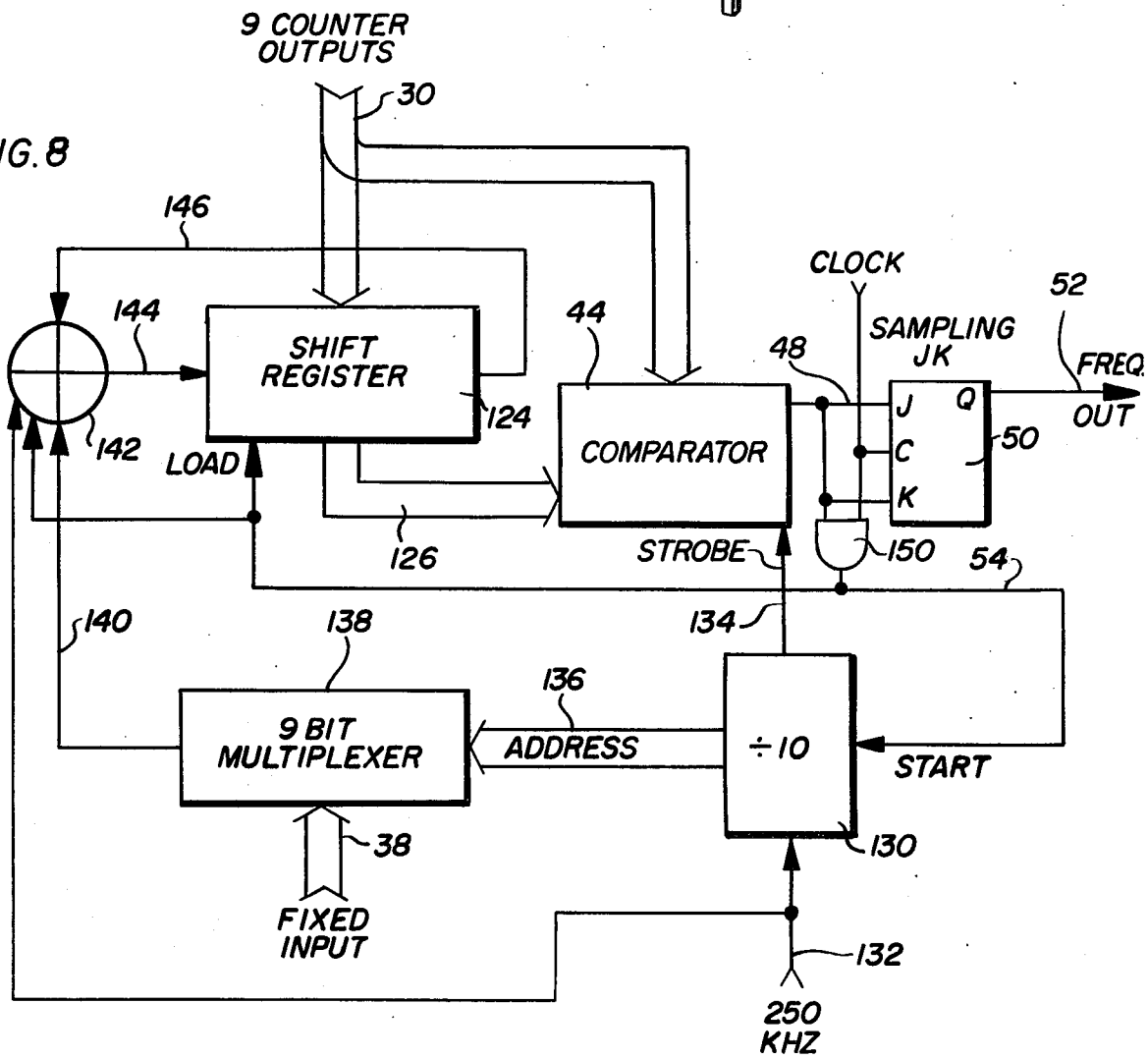
FIG. 8 is a block diagram illustrating a serial addition structure preferably used in the invention.

A serial technique for adding interval codes is shown in FIG. 8.

In the circuit of FIG. 8 the nine counter outputs 30 are fed to a shift register 124, the outputs of which are fed on 126 to the comparator 44, the nine counter outputs also being fed to the comparator, as heretofore.

The sampling flip-flop 50 receives the output from the comparator at 48, being connected to both the J and to the K input, the clock being applied to the C input. The Q output provides the frequency out at 52.

There is again a feedback line 54 from gate 150, this time to the shift register, indicated as a load line. Gate 150 has an output every time there is a comparison. The gate 150 output is also connected by line 54 as a start line to a divide-by-ten circuit 130 receiving a 250 KHz input as indicated at 132. An output strobe line 134 leads from the divide-by-10 circuit to the comparator. Address output 136 from the divide-by-10 circuit are passed to the 9 bit multiplexer 138, which has a fixed (interval) input at 38. The output of the 9 bit multiplexer at 140 is a binary serial stream containing the interval number. This serial stream is passed to a binary full adder, or summer 142, having an output 144 leading to the shift register. The other input 146 to the adder comprises the output from the last stage of the shift register.

Figure 9:
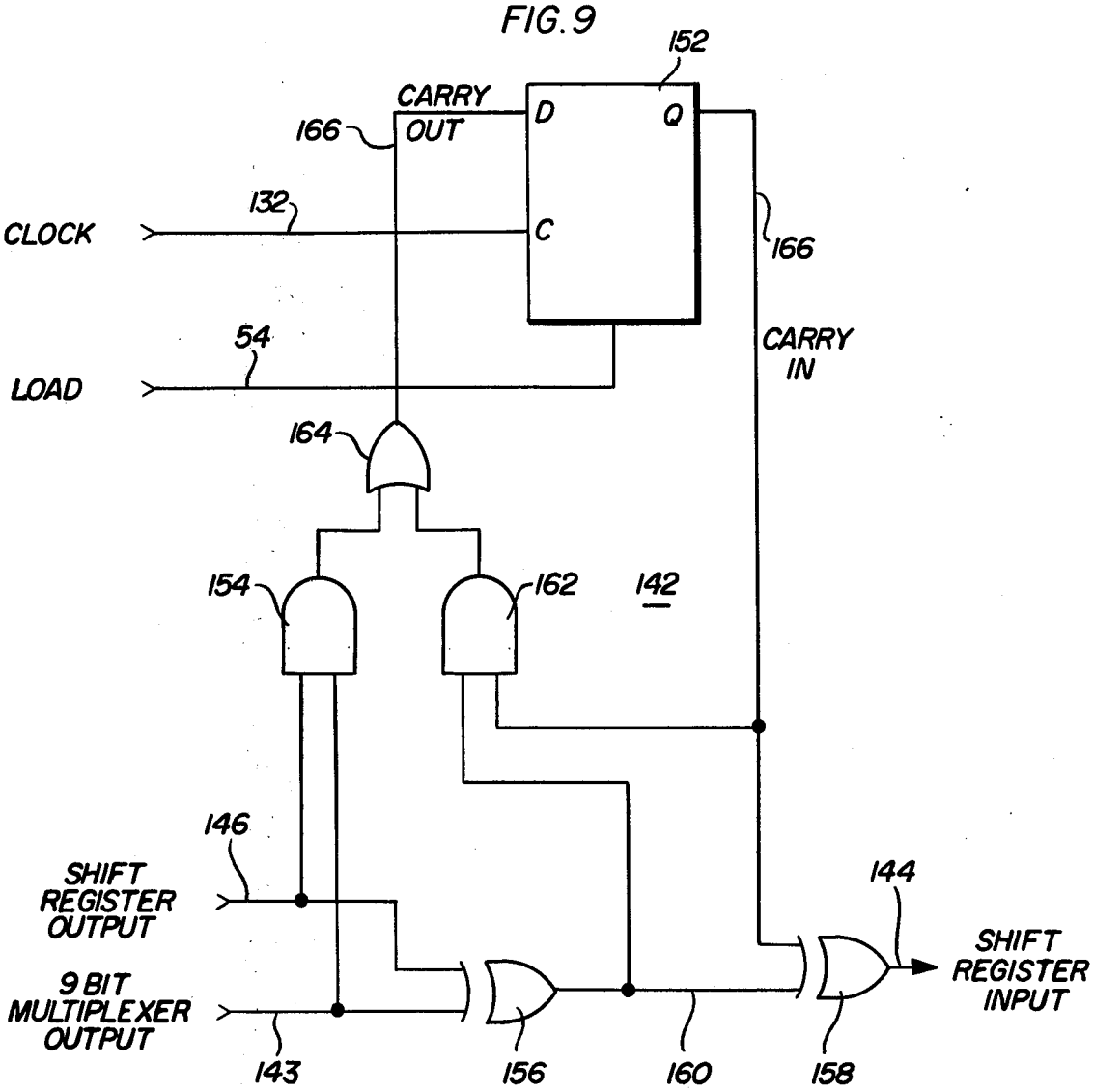
FIG. 9 shows a detail of FIG. 8.

The summer 142 is shown in detail in FIG. 9. The two serial streams to be summed are brought into exclusive OR 156 and AND gate 154 on lines 146 and 143. Exclusive OR output 160 is fed in part to exclusive OR gate 158. The other input to exclusive OR gate 158 comes from storage flip-flop 152. The flip-flop is a type 7474 Texas Instruments chip. This flip-flop is reset by the load signal 54 and clocked by the 250 KHz (line 132). The AND gate 154 output is fed to OR gate 164, along with the output from AND gate 162. The OR gate 164 output 166 is fed to the storage flip-flop D input. The two exclusive OR circuits provide the summed output on line 144. The two AND gates 154 and 162 with OR gate 164 provide the carry output on line 166. This carry output is stored in flip-flop 152 to be used as a delayed carry in signal on line 166. The summed output on line 144 is fed to the shift register input.

The shift register 124 circulates once with its contents added bit by bit, least significant bit first, to the interval number on line 140. At the end of nine counts, the shift register 124 contents is the sum of the interval number and the latched nine counter state.

After the summing process is complete, the strobe signal 134 enables the comparator 44 to examine succeeding counter states to look for comparisons. As previously, the sampling JK triggers on comparisons. Once the sampling JK 50 triggers the serial summing process is repeated.

The specific examples as herein shown and set forth are for illustrative examples. Various changes will no doubt occur to those skilled in the art and would be understood as forming a part of the present invention insofar as they fall within the spirit and scope of the appended claims.

The invention is claimed as follows:

1. A tone generating circuit for an electronic musical instrument comprising means for producing a predetermined frequency, a common digital counter having an input connected to said frequency producing means and having common output means, a plurality of parallel frequency branches connected to said common output means and each comprising a digital processing circuit having a digital output which is either a logical one or zero, and number source means connected to said frequency branches to alternate the digital output between one and zero at a rate determined jointly by said predetermined frequency and said number source means, thus to construct a rectangular wave output of different frequency from each frequency branch.

2. A tone generating circuit as set forth in claim 1 wherein the means for producing a predetermined frequency comprises a clock.

3. A tone generating circuit as set forth in claim 1 wherein the counter comprises a nine bit binary counter.

4. A tone generating circuit as set forth in claim 1 wherein the counter comprises a synchronous counter.

5. A tone generating circuit for an electronic musical instrument comprising means for producing a predetermined frequency, a digital counter having an input connected to said frequency producing means and output means, a plurality of frequency branches connected to said output means and each comprising a digital processing circuit having a digital output which is either a logical one or zero, and number source means connected to said frequency branches to alternate the digital output between one and zero at a rate determined jointly by said predetermined frequency and said number source means, thus to construct a rectangular wave output of different frequency from each frequency branch, including a latch and an adder, said adder receiving one set of inputs from the latch and another set of inputs from a number source means connected to said adder.

6. A tone generating circuit as set forth in claim 1 wherein said number source means comprises a plurality of number sources, one for each frequency branch.

7. A tone generating circuit as set forth in claim 5 wherein said number source means comprises a plurality of number sources, one for each frequency branch.

8. A tone generating circuit as set forth in claim 5 wherein each digital processing circuit further includes a comparator connected to the adder and to said counter.

9. A tone producing circuit as set forth in claim 8 wherein each digital processing circuit further includes an output flip-flop connected to and controlled by the respective comparator and providing the output frequency wave form.

10. A tone generating circuit as set forth in claim 1 wherein said number source means comprises a plurality of different number sources respectively connected to the plurality of like frequency branches, and each number source providing a different, nominally fixed number.

11. A tone generating circuit as set forth in claim 10 and including means for changing at least some of said nominally fixed numbers.

12. A tone generating circuit as set forth in claim 10 wherein each nominally fixed number source comprises a ROM.

13. A tone generating circuit as set forth in claim 11 wherein the means for changing the nominally fixed numbers is arranged to transpose the output frequencies.

14. A tone generating circuit as set forth in claim 11 in which the means for changing the nominally fixed numbers effects a change in duty cycle of the rectangular waves constructed.

15. A tone generating circuit as set forth in claim 1 wherein the number source means comprises a ROM.

16. A tone generating circuit for an electronic musical instrument comprising a clock, a digital counter having an input connected to said clock and having output means, and a plurality of like frequency branches each comprising a digital processing circuit including a buffer connected to said counter output means, an adder connected to said buffer, a nominally fixed number source connected to said adder, a comparator connected to said adder and also to said counter output, and a flip-flop output means connected to said comparator and controlled thereby to produce either a logical one or zero output, said counter output means and said nominally fixed number source controlling conjointly the state of said output flip-flop to construct a rectangular wave output of different frequency in each frequency branch.

17. A tone generating circuit as set forth in claim 16 wherein said buffer comprises a latch.

18. A tone generating circuit as set forth in claim 16 wherein said number source comprises a predetermined combination of a fixed voltage and ground connected to different inputs to said adder.

19. A tone generating circuit as set forth in claim 16 wherein said number source comprises a ROM.

20. A tone generating circuit as set forth in claim 16 and further including a feedback circuit from said comparator to said buffer.

21. A tone generating circuit as set forth in claim 1 and further including multiplexing means for serially adding the output of said binary counter and said number source means at a rate other than that of said predetermined frequency.

22. A digitally encoded waveform generator comprising a clock, a free running digital counter having an input connected to said clock and having output means, a digital processing circuit connected to said output means and having a digital output which is either a logical one or zero, and a number source connected to said digital processing circuit to alternate the digital output between one and zero at a rate determined jointly by said clock and said number source, thus to construct a rectangular wave output.

23. A digitally encoded frequency generator as set forth in claim 22 wherein said number source comprises means for changing the number supplied thereby to said digital processing circuit, in a time variable manner.

24. A digitally encoded frequency generator as set forth in claim 23 wherein the number source comprises a ROM and control means for addressing said ROM.

25. A digitally encoded frequency generator as set forth in claim 24 wherein the counter addressing said ROM is driven by the rectangular wave output.

26. A digitally encoded frequency generator as set forth in claim 24 wherein the counter addressing said ROM is driven by a separate clock or external means.

27. A digitally encoded frequency generator as set forth in claim 22 including a plurality of like parallel digital processing circuits connected to said counter output means, and a plurality of number sources each connected to one of said digital processing circuits.

* * * * *

UNITED STATES PATENT AND TRADEMARK OFFICE

CERTIFICATE OF CORRECTION

PATENT NO. : 4,137,810

DATED : February 6, 1979

INVENTOR(S) : Robert W. Wheelwright & Peter E. Solender

It is certified that error appears in the above-identified patent and that said Letters Patent are hereby corrected as shown below:

Column 6, line 59, change "Q" to --$\bar{Q}$--;

Column 7, line 3, change "Q" to --$\bar{Q}$--;

Column 7, line 14, after "OR" and before "104" insert --gate--;

Column 8, line 22, change "number" to --manner--;

Signed and Sealed this

*Twenty-fifth* Day of *September 1979*

[SEAL]

*Attest:*

*Attesting Officer*

LUTRELLE F. PARKER

*Acting Commissioner of Patents and Trademarks*